US010243293B2

(12) United States Patent
Umemura et al.

(10) Patent No.: US 10,243,293 B2
(45) Date of Patent: Mar. 26, 2019

(54) DEVICE CONNECTOR

(71) Applicants: SUMITOMO WIRING SYSTEMS, LTD., Yokkaichi-shi, Mie (JP); TOYOTA JIDOSHA KABUSHIKI KAISHA, Toyota-shi, Aichi (JP)

(72) Inventors: Kenji Umemura, Mie (JP); Yusuke Sakamoto, Okazaki (JP)

(73) Assignees: Sumitomo Wiring Systems, Ltd. (JP); Toyota Jidosha Kabushiki Kaisha (JP)

( * ) Notice: Subject to any disclaimer, the term of this patent is extended or adjusted under 35 U.S.C. 154(b) by 0 days.

(21) Appl. No.: 15/745,723

(22) PCT Filed: Jul. 7, 2016

(86) PCT No.: PCT/JP2016/070090
§ 371 (c)(1),
(2) Date: Jan. 18, 2018

(87) PCT Pub. No.: WO2017/014055
PCT Pub. Date: Jan. 26, 2017

(65) Prior Publication Data

US 2018/0212353 A1 Jul. 26, 2018

(30) Foreign Application Priority Data

Jul. 22, 2015 (JP) ..... 2015-144624

(51) Int. Cl.
*H01R 13/512* (2006.01)
*H01R 13/6581* (2011.01)
*H01R 13/52* (2006.01)

(52) U.S. Cl.
CPC ..... *H01R 13/512* (2013.01); *H01R 13/52* (2013.01); *H01R 13/6581* (2013.01)

(58) Field of Classification Search
CPC ... H01R 13/512; H01R 13/52; H01R 13/6581
See application file for complete search history.

(56) References Cited

U.S. PATENT DOCUMENTS 7,402,075 B1 * 7/2008 Probst ..... H01R 4/2433 439/410
7,572,150 B2 8/2009 Matsuoka
(Continued)

FOREIGN PATENT DOCUMENTS

CN 103688424 A 3/2014
JP 2003317876 11/2003
(Continued)

OTHER PUBLICATIONS

International Search Report dated Oct. 4, 2016.
Japanese Office Action dated May 9, 2017.

*Primary Examiner* — Truc T Nguyen
(74) *Attorney, Agent, or Firm* — Gerald E. Hespos; Michael J. Porco; Matthew T. Hespos

(57) ABSTRACT

A device connector disclosed herein is a device connector configured to be attached to a casing of a device. The device connector includes a housing, a shield bracket integrally formed with the housing and configured to be fixed to the casing with a fixing bolt to fix the housing, a cover covering the housing and fixed to the shield bracket with the fixing bolt, and a tool blocking portion included in a shell cover of the cover and located adjacent to a rear side of the fixing bolt for fixing the shield bracket to the casing when the shell cover is fixed to the shield bracket. The tool blocking portion blocks access of a tool to the fixing bolt for fixing the shield bracket to the casing.

8 Claims, 5 Drawing Sheets

(56) References Cited

U.S. PATENT DOCUMENTS

| | | | | |
|---|---|---|---|---|
| 9,362,653 | B2 * | 6/2016 | Tanaka | H01R 13/713 |
| 9,407,049 | B2 | 8/2016 | Ishibashi et al. | |
| 9,722,361 | B2 | 8/2017 | Tanaka et al. | |
| 2009/0029594 | A1 | 1/2009 | Matsuoka | |
| 2010/0105223 | A1 * | 4/2010 | Taguchi | H01R 4/305 439/76.2 |
| 2012/0309239 | A1 * | 12/2012 | Onoda | H01R 11/284 439/766 |
| 2014/0030563 | A1 * | 1/2014 | Hoshi | H01M 2/1077 429/72 |
| 2014/0113489 | A1 | 4/2014 | Tanaka et al. | |
| 2014/0127939 | A1 | 5/2014 | Ishibashi et al. | |
| 2014/0241833 | A1 * | 8/2014 | Grossmann | H02B 1/052 411/500 |
| 2014/0294207 | A1 * | 10/2014 | Siegel | H01R 9/223 381/120 |
| 2015/0037649 | A1 * | 2/2015 | Wyatt | H01M 10/625 429/120 |
| 2015/0079855 | A1 * | 3/2015 | Takemura | H01R 9/18 439/813 |
| 2018/0312123 | A1 * | 11/2018 | Umemura | B60R 16/0215 |
| 2018/0366866 | A1 * | 12/2018 | Yokotani | H01R 13/5219 |

FOREIGN PATENT DOCUMENTS

| | | |
|---|---|---|
| JP | 2009-32500 | 2/2009 |
| JP | 2012160355 | 8/2012 |
| JP | 2014-93289 | 5/2014 |
| JP | 2015092441 | 5/2015 |

* cited by examiner

DEVICE CONNECTOR

BACKGROUND

Field of the Invention

The technology disclosed herein relates to a device connector.

Description of the Related Art

For example, Japanese Unexamined Patent Application Publication No. 2012-160355 describes a terminal block with a shield shell. The terminal block includes a metal cover plate fixed to a casing with bolts, a connector housing integrally formed with the cover plate, and a shield shell fixed to the casing with bolts together with the cover plate while covering the connector housing. Two bolts are used to fix each of the cover plate and the shield shell to the casing.

For maintenance of the terminal block, for example, the bolts for the shield shell are removed with the cover plate being fixed to the casing, and only the shield shell is detached.

However, in the above-described connector, the terminal block will have backlash if an operator mistakenly loosens the bolts for the cover plate.

This specification discloses a technology of preventing an operator from mistakenly removing wrong bolts.

SUMMARY

A technology disclosed herein relates to a device connector configured to be attached to a casing of a device. The device connector includes a housing, a bracket integrally formed with the housing to fix the housing to the casing with a fixing member, a cover fixed to the casing or the bracket with a fixing member to cover the housing, and a tool blocking portion for blocking access of a tool to the fixing member fixed to the bracket. The tool blocking portion is included in the cover fixed to the casing or the bracket and located adjacent to the fixing member fixed to the bracket.

In the device connector having such a configuration, when the cover is fixed to the casing or the bracket, the tool blocking portion is located adjacent to the fixing member that is fixed to the bracket. Thus, the tool cannot access to the fixing member that is fixed to the bracket. An operator is less likely to mistakenly access the fixing member fixed to the bracket with the tool. Therefore, accidental removal of the fixing member from the bracket is less likely to occur and thus backlash due to the accidental removal of the fixing member is less likely to occur.

The device connector disclosed herein may have the following configurations.

The fixing member may be a fixing bolt to be tightened on the casing. The tool blocking portion may be located at a rear side of a head of the fixing bolt in a direction of tightening.

With this configuration, it is recognizable at a glance that the fixing bolt fixed to the bracket is not accessible by the tool. Thus, this configuration has higher operation efficiency, for example, compared with a configuration having the tool blocking portion on a lateral side of the fixing bolt, which does not allow an operator to determine at a glance whether the head of the fixing bolt is accessible by the tool.

The cover may include a main plate covering a rear of the housing and a side plate extending from an outer peripheral edge of the main plate toward the bracket. The side plate may have a cutout to avoid contact with the fixing bolt. The tool blocking portion may cover a portion of the fixing bolt in the cutout from the rear side in the direction of tightening.

Meanwhile, for example, a tool cannot access the fixing bolt fixed to the bracket when a tool blocking portion completely covers the fixing bolt fixed to the bracket. However, the tool blocking portion completely covering the fixing bolt fixed to the bracket should have a slightly larger size than the fixing bolt, increasing the overall size of the cover.

However, since the tool blocking portion disclosed herein covers a portion of the fixing bolt in the cutout from the rear side in the direction of tightening, such a configuration restricts access of the tool to the fixing bolt without an increase in size of the cover and without contact between the side plate and the fixing bolt.

The technology disclosed herein prevents an operator from mistakenly handling the bolt.

DETAILED DESCRIPTION

An embodiment is described with reference to FIG. 1 to FIG. 5.

Figure 1:
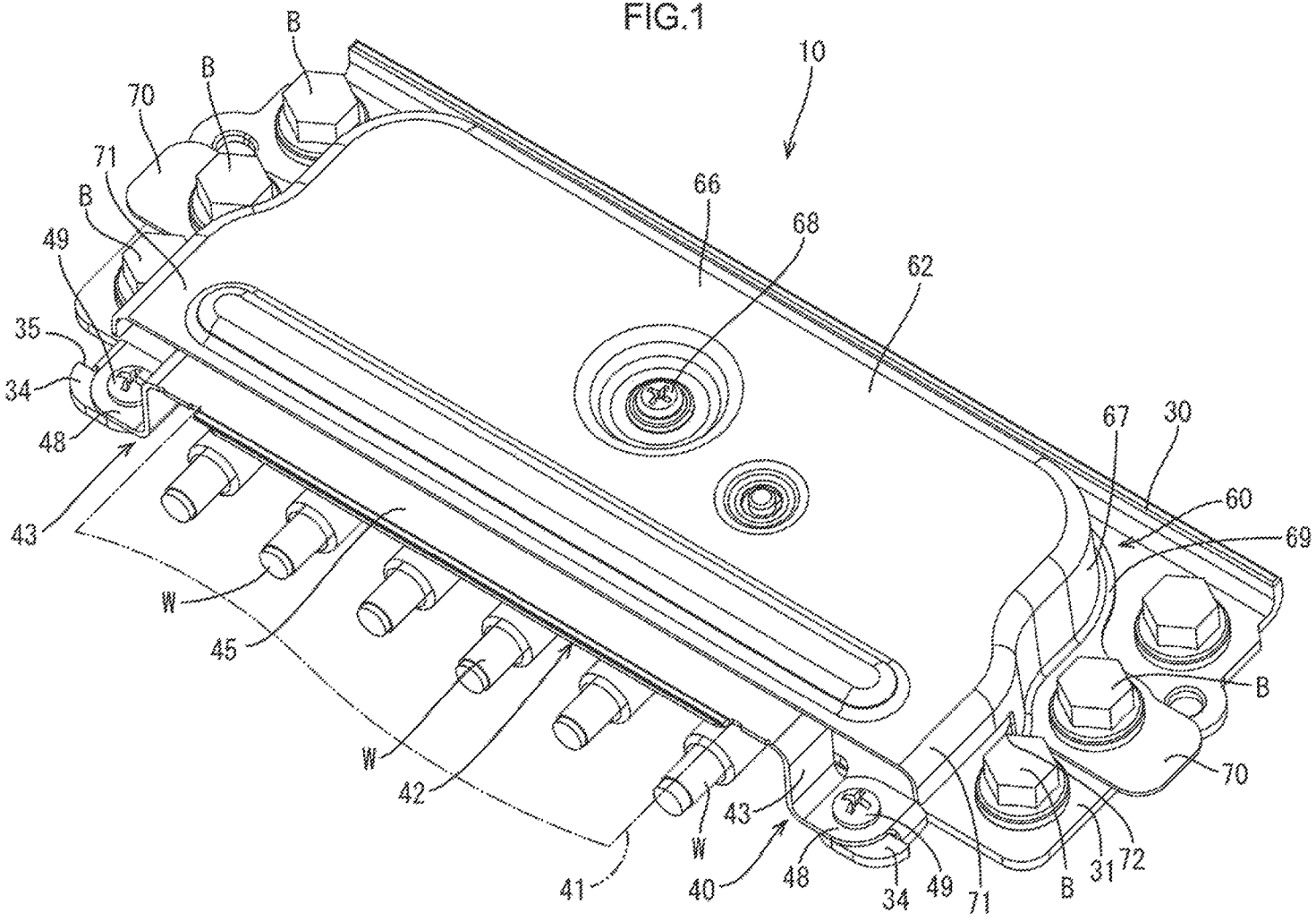
FIG. 1 is a perspective view of a device connector.

In this embodiment, as illustrated in FIG. 1, a device connector 10 having a shielding function and being configured to be attached to a casing C of a device mounted in an engine room of a vehicle is described as an example. In the following description, a front-back direction is based on a left-right direction in FIG. 3 and FIG. 4, and a side of the device connector 10 attached to a casing C is referred to as a front side.

Figure 3:
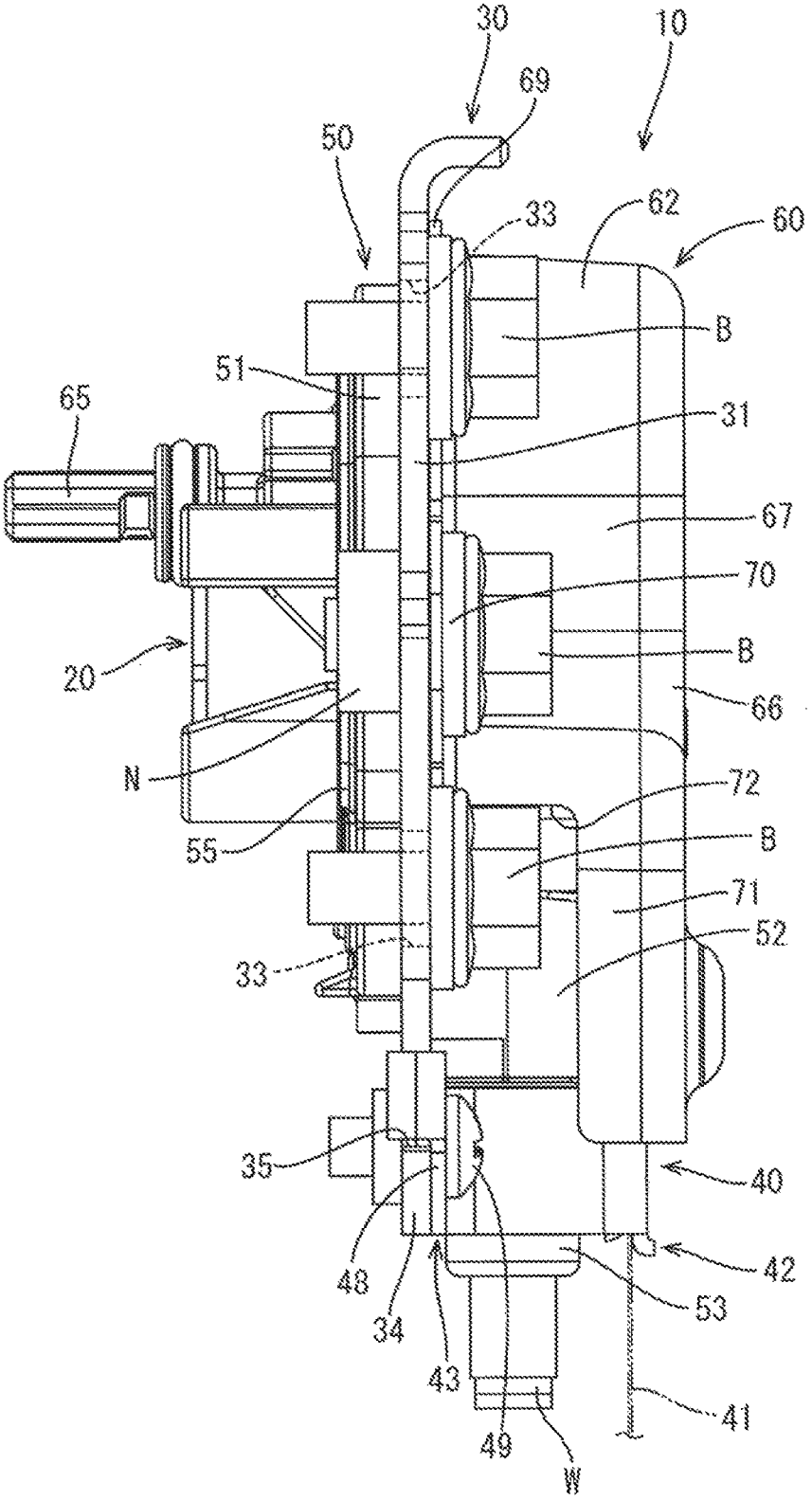
FIG. 3 is a side view of the device connector.
Figure 4:
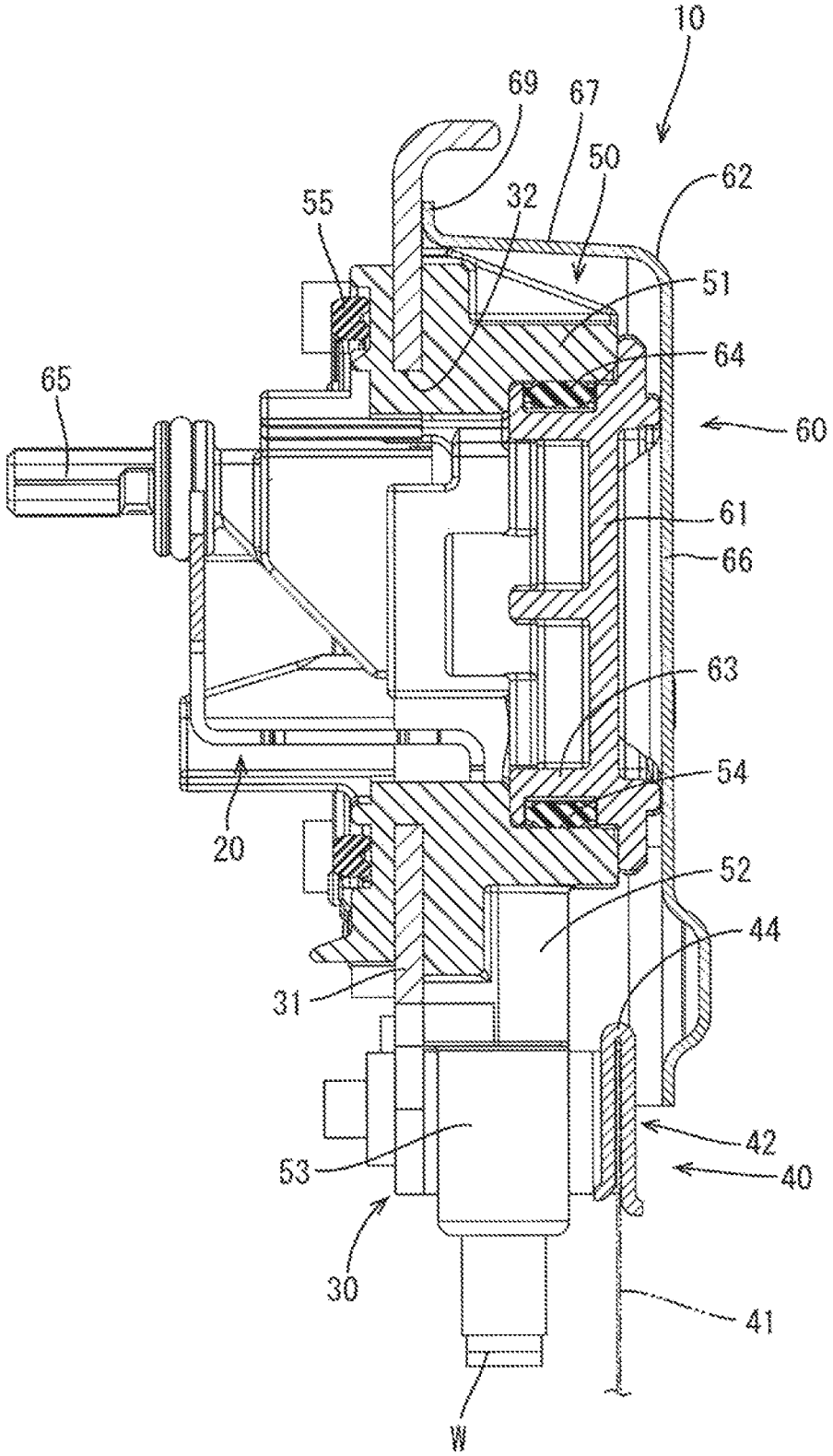
FIG. 4 is a cross-sectional view taken along line A-A in FIG. 2.

As illustrated in FIG. 1, FIG. 3, and FIG. 4, the device connector 10 includes a terminal 20 connected to a terminal of an electric wire W and to be connected with a bolt to a device-side terminal (not illustrated) in the casing C, a shied bracket (one example of a "bracket") 30 having a plate body 31 having a planar shape, a shield connector 40 connected to a shield conductor 41, which covers the electric wire W, and connected and fixed to the shield bracket 30, a housing 50 formed of a synthetic resin and integrally formed with the terminal 20 and the shield bracket 30, and a cover 60 attached to the housing 50 from the rear side.

As illustrated in FIG. 4, the housing 50 includes a tubular portion 51 having a tubular shape and supporting the terminals 20, a plurality of electric wire leading portions 53 through which the electric wires W connected to the terminals 20 extend downward to the outside, and a connection portion 52 integrally formed with the tubular portion 51 and the electric wire leading portion 53 to connect the tubular portion 51 and the electric wire leading portion 53 to each other.

The tubular portion 51 is horizontally long, i.e., long in the left-right direction, and has front and rear openings. The rear opening of the tubular portion 51 is an operation hole 54 through which fastening bolts and a tool (not illustrated) for connecting the device terminals and the terminals 20 with bolts are inserted.

In the tubular portion 51, the terminals 20 supported by the inner wall of the tubular portion 51 are located side by side in the left-right direction.

The terminals 20 each have a crank-shape having an end portion extending upward. The terminals 20 each extend upward from a lower surface of the inner wall of the tubular portion 51 and turn and extend frontward and then upward in a bent form. The terminals 20 are held in the tubular portion 51 with the end portions protruding frontward from the front opening of the tubular portion 51. The terminals 20 each have an insertion hole 21 at the end portion into which a fastening bolt is inserted.

As illustrated in FIG. 4, a portion of the plate body 31 around a through hole 32 extending through the plate body 31 of the shield bracket 30 in the front-back direction is buried in the peripheral wall of the tubular portion 51. Thus, the tubular portion 51 is integrated with the shield bracket 30. The tubular portion 51 extends through the plate body 31 in the front-back direction.

A seal packing 55 extending along the front opening edge of the tubular portion 51 is attached to a portion of the tubular portion 51 located in front of the portion where the plate body 31 of the shield bracket 30 is buried. When the device connector 10 is attached to the casing C, the seal packing 55 is sandwiched between the outer surface of the casing C and the front surface of the tubular portion 51 in the front-back direction and functions as a water stop between the casing C and the housing 50.

Figure 5:
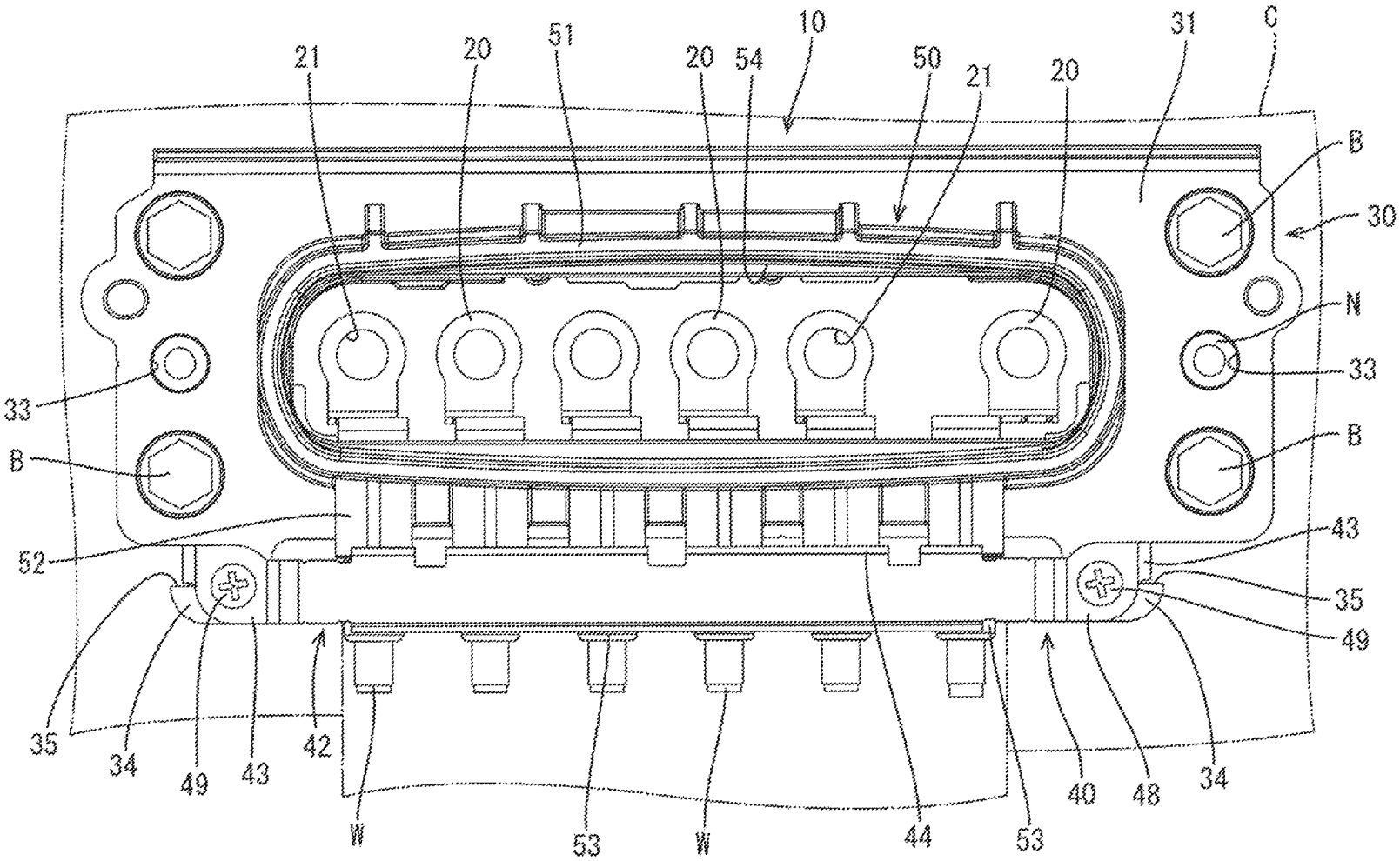
FIG. 5 is a plan view illustrating a state without a shell cover.

As illustrated in FIG. 4 and FIG. 5, the connection portion 52 has a horizontally long block shape and fills the portion where the terminal 20 and the electric wire W are connected to each other.

The electric wire leading portions 53 each have a cylindrical shape extending along the electric wire W and allowing the electric wire W to extend downward from the lower end of the connection portion 52. The electric wire leading portions 53 are located next to each other with an equal distance therebetween in the left-right direction at the lower end of the connection portion 52.

Figure 2:
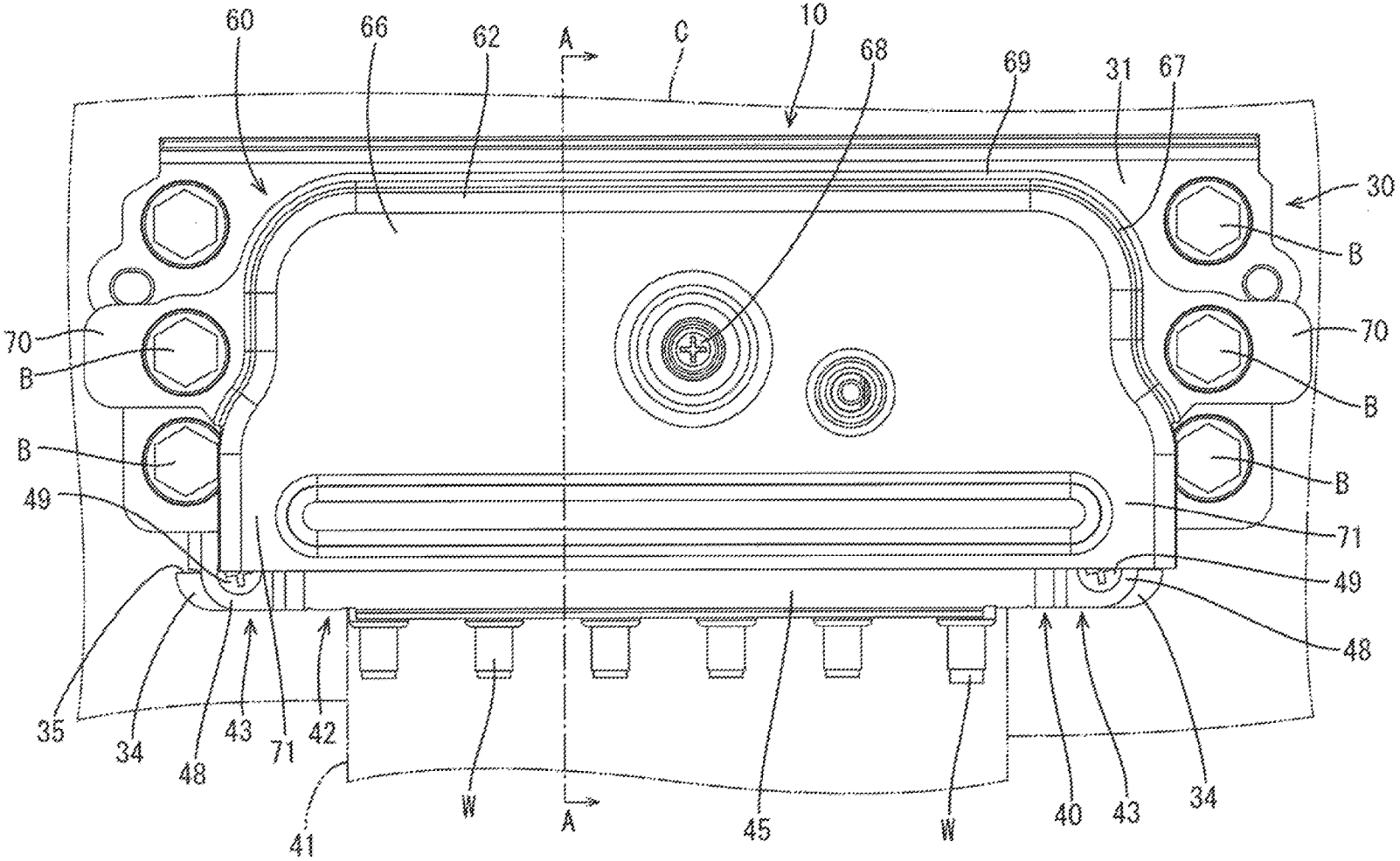
FIG. 2 is a plan view of the device connector.

The shield bracket 30 is formed of metal and the plate body 31 has a substantially horizontally long rectangular shape, which is long in the left-right direction, as illustrated in FIG. 1, FIG. 2, and FIG. 5. The plate body 31 has three bolt insertion holes 33 arranged next to each other in the up-down direction at each of the left end and the right end. The bolt insertion holes 33 extend through the plate body 31 in the front-back direction, which is the thickness direction. As illustrated in FIG. 3, shafts B1 of fixing bolts (one example of a "fixing member") B are inserted into the top and bottom bolt insertion holes 33 of the three bolt insertion holes 33, and the shafts B1 are each fastened to fastening seat (not illustrated) on the casing C with a tool held on a head B2 of the fixing bolt B. Thus, the shield bracket 30 is fixed to the casing C by the four fixing bolts B.

In short, as illustrated in FIG. 5, since the shield bracket 30 is fixed to the casing C by the four fixing bolts B inserted into the bolt insertion holes 33 at the four corners of the plate body 31, the housing 50 is kept fixed to the casing C.

Furthermore, as illustrated in FIG. 3 and FIG. 5, a nut N for tightening the fixing bolt B is fixed to the front surface of the plate body 31 around the middle bolt insertion hole 33 of the three bolt insertion holes 33 arranged in the up-down direction.

As illustrated in FIG. 1 and FIG. 5, two supporting pieces 34, to which the shield connector 40 is connected and fixed, are disposed at a lower end of the plate body 31. The two supporting pieces 34 are located slightly inward of the left and right ends of the plate body 31 and located on the left and right sides of the area of the housing 50 where the electric wire leading portions 53 are disposed.

The supporting pieces 34 each have a plate shape extending in the left-right direction and have a slit 35. The slits 35 open outwardly to the left and right, i.e., in opposite directions, and extend through the supporting pieces 34 in the thickness direction.

The shield connector 40 is formed by pressing a metal plate having high conductivity, for example. As illustrated in FIG. 1, the shield connector 40 includes a horizontally long conductor connecting portion 42, which is long in the left-right direction, and two attachment pieces 43 at the left and right ends of the conductor connecting portion 42. The conductor connecting portion 42 is connected to the upper end portion of the shield conductor 41.

The shield conductor 41 is a flexible conductive metal cloth and is a substantially rectangular sheet formed of woven metal threads. As illustrated in FIG. 1 and FIG. 4, the shield conductor 41 has a size enough to collectively cover the electric wire leading portions 53 of the housing 50 and the electric wires W, which extend from the electric wire leading portions 53, from the rear side. In other words, the shield conductor 41 is slightly larger in the left-right direction than the area including the electric wire leading portions 53 and the electric wires W. The shield conductor 41 is attached to the shield connector 40 to cover the electric wire leading portions 53 and the electric wires W from the rear side.

As illustrated in FIG. 4 and FIG. 5, the conductor connecting portion 42, which is formed by folding a horizontally long flat plate in half at a bent portion 44 located at a substantially middle in the up-down direction, sandwiches the upper end portion of the shield connector 41 in the front-rear direction.

As illustrated in FIG. 1, the two attachment pieces 43 include contact portions 48 extending frontward from the lateral ends of the conductor connecting portion 42 and then extending from the front end to the left and right so as to be away from each other. The attachment pieces 43 include end portions extending further frontward from the contact portions 48. The contact portions 48 of the attachment pieces 43 are in contact with the rear surfaces of the supporting pieces 34 of the shield bracket 30, and the end portions of the attachment pieces 43 are fitted into the slits 35 of the two supporting pieces 34 from the rear side. Thus, the shield connector 40 is temporally fixed to the plate body 31. Then, the two supporting pieces 34 and the contact portions 48 are fixed with screws 49 to electrically connect the plate body 31 of the shield bracket 30 and the shield connector 40 to each other.

The cover 60 includes a service cover 61 formed of a synthetic resin and a shell cover 62 formed of metal. The service cover 61 covers the operation hole 54 in the tubular portion 51 of the housing 50. The shell cover 62 is attached to the rear surface of the service cover 61.

The service cover 61 has a horizontally long shape, which is long in the left-right direction, and as illustrated in FIG. 4, has a fitting portion 63 fitted into the operation hole 54 of the tubular portion 51 from the rear side. A ring-shaped seal ring 64 is fitted to the outer surface of the fitting portion 63. When the fitting portion 63 is fitted into the operation hole 54, the seal ring 64 comes in close contact with the tubular portion 51 and the fitting portion 63 and functions as a water stop between the tubular portion 51 and the fitting portion 63, preventing water or the like from entering the operation hole 54.

Furthermore, as illustrated in FIG. 4, at the front end of the fitting portion 63, an interlock connector 65 configured to be fitted to a receiving-side connector (not illustrated) in the casing C is disposed in a movable manner in the up-down direction and the left-right direction.

The shell cover 62 is formed by pressing a thin metal plate, for example. As illustrated in FIG. 1 and FIG. 4, the shell cover 62 includes a main plate 66, which is larger in the up-down direction and the left-right direction than the tubular portion 51 of the housing 50, and a side plate 67, which extends frontward from an outer peripheral edge of the main plate 66 toward the shield bracket 30.

The main plate 66 has a substantially horizontally long rectangular shape, which is long in the left-right direction, and is large enough to completely cover the tubular portion 51 of the housing 50 from the rear side. As illustrated in FIG. 1 and FIG. 2, a fixing screw 68 is disposed at the substantially middle portion in the up-down direction and the left-right direction of the main plate 66 to connect the service cover 61 and the shell cover 62 to each other. The fixing screw 68 passed through the main plate 66 of the shell cover 62 is tightened on the service cover 61 such that the shell cover 62 is fixed to the rear surface of the service cover 61.

As illustrated in FIG. 1 and FIG. 4, the side plate 67 extends along the outer peripheral edge of the main plate 66, i.e., along the upper, left, and right edges of the main plate 66. The side plate 67 continuously extends from one lateral edge to the other lateral edge.

As illustrated in FIG. 1, FIG. 2, and FIG. 4, the front end portion of the side plate 67 is a plate contact portion 69 extending in a radial outward direction in a bent form. The plate contact portion 69 is in contact with the rear surface of the plate body 31 of the shield bracket 30 when the cover 60 is attached to the housing 50. The plate contact portion 69 electrically connects the shell cover 62 and the shield bracket 30 to each other.

Furthermore, as illustrated in FIG. 1 and FIG. 2, two fixing pieces 70 extending outwardly from the front edge of the side plate 67 to the left and right are located at substantially middle portions in the up-down direction of the side plate 67. The two fixing pieces 70 each have a substantially rectangular plate shape so as to be in contact with the rear surface of the plate body 31. The fixing pieces 70 are each located at the rear side of the middle bolt insertion hole 33, which is one of the three bolt insertion holes 33 arranged on the plate body 31 in the up-down direction.

The fixing pieces 70 each have a through hole (not illustrated) extending through the fixing piece 70 in the front-back direction, which is the thickness direction. A fixing bolt B is inserted into the through hole and tightened on the nut Non the plate body 31 such that the fixing piece 70 is fixed and electrically connected to the rear surface of the plate body 31. Thus, the cover 60 is fixed to the shield bracket 30.

As illustrated in FIG. 2, the main plate 66 of the shell cover 62 includes two tool blocking portions 71 at left and right end portions of the lower half. The tool blocking portions 71 partly cover the heads B2 of the lower fixing bolts B at the left and right, which are two of the fixing bolts B fixed to the shield bracket 30, from the rear side in the tightening direction.

More specifically, as illustrated in FIG. 2, the tool blocking portions 71, which are lower portions of the main plate 66 located below the substantially middle in the up-down direction, protrude more to the left and right than the upper portion of the main plate 66 and have left and right ends at positions slightly away from the left and right ends of the upper portion of the main plate 66 in the left-right direction. Furthermore, the tool blocking portions 71 are each located adjacent to the rear side of the head B2 of each of the left and right lower fixing bolts B when the cover 60 is attached to the shield bracket 30. A portion of the head B2 of the fixing bolt B is covered by the tool blocking portion 71 located adjacent to the rear side of the head B2 of the fixing bolt B.

Furthermore, as illustrated in FIG. 1 and FIG. 3, the side plate 67 has cutouts 72 slightly larger in the front-back direction than the height of the head B2 of the fixing bolt B at the positions corresponding to the tool blocking portions 71.

The cutout 72 has a substantially rectangular shape in side view and extends straightly upward from the lower edge of the shell cover 62 along the plate body 31 of the shield bracket 30 to about the same height as the lower fixing bolt B. When the cover 60 is attached to the shield bracket 30, the head B2 of the fixing bolt B is positioned in the cutout 72, preventing the head B2 of the fixing bolt B from contacting the side plate 67.

The present embodiment has the above-described configuration. The operation and effect of the device connector 10 is described.

When the device connector 10 is attached to the casing C, the plate body 31 is attached to the casing C such that the bolt insertion holes 33 located at the four corners of the shield bracket 30 are aligned with the mounting seats of the casing C. As illustrated in FIG. 5, the four fixing bolts B are inserted into the bolt insertion holes 33 and tightened on the mounting seats of the casing C such that the shield bracket 30 is fixed to the casing C.

Furthermore, the housing 50 is also fixed to the casing C when the shield bracket 30 is fixed to the casing C. The seal packing 55 attached to the housing 50 is sandwiched between the outer surface of the casing C and the tubular portion 51 of the housing 50, and the seal packing 55 functions as a water stop between the casing C and the housing 50.

Next, fastening bolts and a tool, which are not illustrated, are inserted into the operation hole 54 of the tubular portion 51 of the housing 50 from the rear side, and the terminals 20 and device terminals are connected to each other with fastening bolts.

After the terminals 20 and the device terminals are connected to each other with the fastening bolts, the cover 60 is attached to the housing 50 such that the fitting portion 63 of the service cover 61 of the cover 60 is fitted into the operation hole 54.

Then, at the end, the fixing bolts B are inserted into the fixing pieces 70 of the shell cover 62, which are located behind the bolt insertion holes 33 of the plate body 31. As illustrated in FIG. 1 to FIG. 3, when the fixing bolts B are tightened on the nuts N on the plate body 31, the plate contact portion 69 and the rear surface of the plate body 31 are electrically connected to each other and the fixing pieces 70 are fixed to the rear surface of the plate body 31.

Here, when the cover 60 is attached to the shield bracket 30, the head B2 of the fixing bolt B is positioned in the cutout 72, preventing the side plate 67 from being in contact with the head B2 of the fixing bolt B. After the cover 60 is fixed to the shield bracket 30, the tool blocking portions 71 are located behind the heads B2 of the left and right lower fixing bolts B, allowing the tool blocking portions 71 to cover portions of the heads B2 of the fixing bolts B.

In other words, when the cover 60 is fixed to the shield bracket 30 and the attachment of the device connector 10 to the casing C is finished, as illustrated in FIG. 2, the two upper fixing bolts B, which fix the shield bracket 30 to the casing C, and the two middle fixing bolts B, which fix the cover 60 to the shield bracket 30, are completely exposed, but the heads B2 of the left and right lower fixing bolts B are partly covered and hidden by the tool blocking portion 71 from the rear side.

Meanwhile, removal of the cover 60 is required for maintenance of the device connector 10 in some cases. In such cases, the tool is held on the heads B2 of the fixing bolts B, which are two at the middle in the up-down direction of the six fixing bolts B, and the two fixing bolts B at the middle are removed to detach the cover 60 from the shield bracket 30.

However, if an operator mistakenly holds the tool on the upper and lower fixing bolts B, not the middle fixing bolt B, and removes the upper and lower fixing bolts B at the left or right side, which fix the shield bracket 30 to the casing C, the shield bracket 30 would have backlash with respect to the casing C. Furthermore, if all the four upper and lower fixing bolts B, which fix the shield bracket 30 to the casing C, are removed, the device connector 10 would be detached from the casing C with the terminals 20 and the device terminals being connected to each other with bolts.

However, as illustrated in FIG. 2, in the device connector 10 according to the present embodiment, when the cover 60 is fixed to the shield bracket 30, the tool blocking portions 71 are each located adjacent to the rear side of the head B2 of the left or right lower fixing bolt B, and thus an operator cannot hold the tool on the left and right lower fixing bolts B. This prevents the left and right lower fixing bolts B from being detached.

Furthermore, as illustrated in FIG. 2, in the present embodiment, the heads B2 of the fixing bolts B are partly covered by the tool blocking portion 71. Thus, it is recognizable at a glance that the tool is not accessible to the lower fixing bolts B.

In other words, an operator may mistakenly holds the tool on the upper fixing bolt B and removes the upper fixing bolt B. In such a case, the lower left and right bolts B are not able to be removed. Thus, this configuration prevents not only detachment of the device connector 10 from the casing C with the terminals 20 and the device terminals being connected to each other, but also prevents backlash of the shield bracket 30 with respect to the casing C.

Furthermore, for example, this configuration has high operation efficiency compared with a configuration having tool blocking portions located adjacent to lateral sides of the fixing bolts B, because such a configuration does not allow an operator to determine at a glance whether the tool is accessible to the heads of the fastening bolts and the operator can determine that the access of the tool is blocked by the tool blocking portion only when the operator tries to access the head with a tool.

Meanwhile, for example, the head B2 of the fixing bolt B may be completely covered by a tool blocking portion to block the access of the tool to the lower fixing bolt B. However, if the head B2 of the fixing bolt B is completely covered by a tool blocking portion, the tool blocking portion need to have a larger size than the head B2 of the fixing bolt B. This increases the overall size of the shell cover.

However, as illustrated in FIG. 1 to FIG. 3, in the present embodiment, since the fixing bolt B is in the cutout 72 of the side plate 67 of the shell cover 62, the side plate 67 and the head B2 of the fixing bolt B are prevented from being in contact with each other and the access of the tool to the lower fixing bolt B is blocked. In other words, this configuration not only prevents the side plate 67 and the head B2 of the fixing bolt B from being in contact with each other, but also prevents the shell cover 62 from increasing in size and blocks the access of the tool to the head B2 of the lower fixing bolt B.

As described above, in the present embodiment, when the cover 60 is fixed to the shield bracket 30, the tool blocking portions 71 are located adjacent to the rear side of the lower fixing bolts B, which fixed the shield bracket 30 to the casing C, and the heads B2 of the fixing bolts B are partly covered by the tool blocking portions 71. This blocks the access of the tool to the lower fixing bolts B and this allows an operator to determine at a glance that the access of the tool to the lower fixing bolts B is blocked.

Furthermore, in the present embodiment, the side plate 67 has the cutouts 72 at positions corresponding to the tool blocking portions 71. This prevents the shell cover 62 from increasing in size and prevents the lower fixing bolts B from being removed.

<Other Embodiments>

The technology disclosed herein is not limited to the embodiment described above and illustrated by the drawings. For example, the following aspects will be included in the technical scope of the present invention.

(1) In the above-described embodiment, the tool blocking portions 71 are included in the main plate 66 of the shell cover 62. However, the configuration of the tool blocking portion 71 is not limited to this, and the tool blocking portion may be included in the service cover.

(2) In the above-described embodiment, the tool blocking portions 71 are located adjacent to the rear side of the fixing bolts B. However, the position of the tool blocking portion 71 is not limited to this, and the tool blocking portion may be located adjacent to the left or right side of the fixing bolt to block the access of the tool to the fixing bolt. The tool blocking portion may completely cover the fixing bolt from the rear side.

(3) In the above-described embodiment, the cutout 72 extends from the lower edge of the shell cover 62 to the same height as the lower fixing bolt B. However, the configuration of the cutout 72 is not limited to this, and the cutout may be located only over an area corresponding to the head of the fixing bolt.

(4) In the above-described embodiment, the fixing bolt B is tightened on the casing C. However, the tightening structure is not limited to this, and a nut maybe fastened to a stud bolt in the casing C.

Explanation of Symbols

10: device connector
30: shield bracket (bracket)
50: housing
60: cover
62: shell cover (cover)
66: main plate
67: side plate
71: tool blocking portion
72: cutout
B: fixing bolt (fixing member)
B2: head
C: casing

The invention claimed is:

1. A device connector configured to be attached to a casing of a device, the device connector comprising:

a bracket having opposite first and second faces, the first face being configured to be fixed to the casing by at least one first fixing member; and a cover to be fixed by at least one second fixing member to the second face of the bracket, the cover comprising:

a main plate opposed to the second face of the bracket and including at least one tool blocking portion located adjacent to the at least one first fixing member and extending over a portion of the first fixing member to restrict access of a tool to the at least one first fixing member after the cover is fixed to the bracket, and a side plate extending from an outer peripheral edge of the main plate toward the bracket and including a cutout in which the portion of the at least one first fixing member is disposed.

2. The device connector according to claim 1, wherein the at least one first fixing member is at least one fixing bolt having a head and a shank, the head of the at least one fixing bolt being disposed on the face of the bracket, and the tool blocking portion extends over a portion of the head of the fixing bolt.

3. The device connector according to claim 2, wherein the main plate has a rectangular shape, the outer peripheral edge of the main plate includes at least two short edge sections, and the side plate extends from one of the short edge sections of the outer peripheral edge of the main plate, and the head of the fixing bolt is disposed on the second face of the bracket and in the cutout.

4. The device connector according to claim 1, wherein the main plate has a rectangular shape, the outer peripheral edge of the main plate includes at least two short edge sections, and the side plate extends from one of the short edge sections of the outer peripheral of the main plate.

5. The device connector according to claim 1, wherein the at least one first fixing member includes two first fixing members, and the tool blocking portion is located adjacent to one of the first fixing members.

6. The device connector according to claim 5, wherein the main plate has a rectangular shape, the outer peripheral edge of the main plate includes at least one short edge section, the first fixing members are disposed adjacent to the at least one short edge section and separated from each other along the at least one short edge section, and the at least one second fixing member is disposed between the first fixing members.

7. The device connector according to claim 6, wherein the cover includes a fixing tab extending from the at least one short edge section between the first fixing members, the fixing tab is fixed to the bracket with the at least one second fixing member, and the tool blocking portion extends less than the fixing tab.

8. The device connector according to claim 5, further comprising:

a housing holding an electrical component therein and including a first edge and a second edge opposed to each other; and an electric wire extending from the first edge of the housing, wherein one of the first fixing members is disposed closer to the first edge of the housing, and the tool blocking portion is located adjacent to the one of the first fixing members closer to the first edge of the housing.

* * * * *